United States Patent [19]

Fischer

[11] 4,405,018

[45] Sep. 20, 1983

[54] DEFLECTOR WITH SURFACE FOR CIRCUMFERENTIALLY REDISTRIBUTING FLUID FOR IMPROVED SPRAY UNIFORMITY

[75] Inventor: Michael A. Fischer, North Kingstown, R.I.

[73] Assignee: Grinnell Fire Protection Systems Company, Inc., Providence, R.I.

[21] Appl. No.: 278,439

[22] Filed: Jun. 24, 1981

[51] Int. Cl.[3] ..... A62C 37/08

[52] U.S. Cl. ..... 169/37; 169/40

[58] Field of Search ..... 169/37, 38, 39, 40, 169/41, 90

[56] References Cited

U.S. PATENT DOCUMENTS

| | | | |
|---|---|---|---|
| 329,741 | 11/1885 | Hill . | |
| 372,977 | 11/1887 | Hill . | |
| 440,704 | 11/1890 | Freeman . | |
| 465,851 | 12/1891 | Harsin . | |
| 484,321 | 10/1892 | Kane | 169/40 |
| 485,519 | 11/1892 | Wilson . | |
| 538,593 | 4/1895 | Naylor . | |
| 591,266 | 10/1897 | Bishop | 169/39 |
| 768,676 | 8/1904 | McDaniel . | |
| 1,045,701 | 11/1912 | Grimes . | |
| 1,290,298 | 1/1919 | Newton . | |
| 2,768,696 | 10/1956 | Sherburne | 169/37 |
| 3,195,647 | 7/1965 | Campbell et al. | 169/1 |
| 3,459,266 | 8/1969 | Ault | 169/37 |
| 3,525,402 | 8/1970 | Hattori | 169/40 |
| 3,810,511 | 5/1974 | James | 169/37 |
| 4,060,201 | 11/1977 | Tomita | 239/553 |
| 4,091,873 | 5/1978 | Werner | 169/37 |
| 4,128,128 | 12/1978 | Mears | 169/37 |
| 4,280,562 | 7/1981 | Glinecke | 169/37 |

*Primary Examiner*—Joseph J. Rolla
*Assistant Examiner*—Charles C. Compton

[57] ABSTRACT

The invention features improved fluid deflection techniques for a pendent-type fire-protection sprinkler head. A first deflecting surface facing generally upward is positioned in the path of fluid emerging from the body of the sprinkler and includes a portion spaced to circumferentially redistribute the fluid to improve uniformity of distribution and deflect at least some of the fluid generally outward. A second deflecting surface positioned radially outward and away from the first deflecting surface receives and controls the distribution of a portion of the outwardly moving water from the first surface; the path of emerging fluid from the sprinkler head body to the first deflector surface extends through an interior opening in the second deflector surface; and the second surface is separated from the first surface by a circumferentially unobstructed region so that the circumferential distribution of the fluid leaving the first surface is not divided as it moves between the first and second surfaces. The dependent structure that supports the first deflecting surface is such that it causes a disturbance in the flow before the flow reaches the first deflecting surface and the first deflecting surface is effective in redistributing the fluid to reduce the uneveness in circumferential distribution which is a result of the disturbance.

4 Claims, 11 Drawing Figures

FIG 1
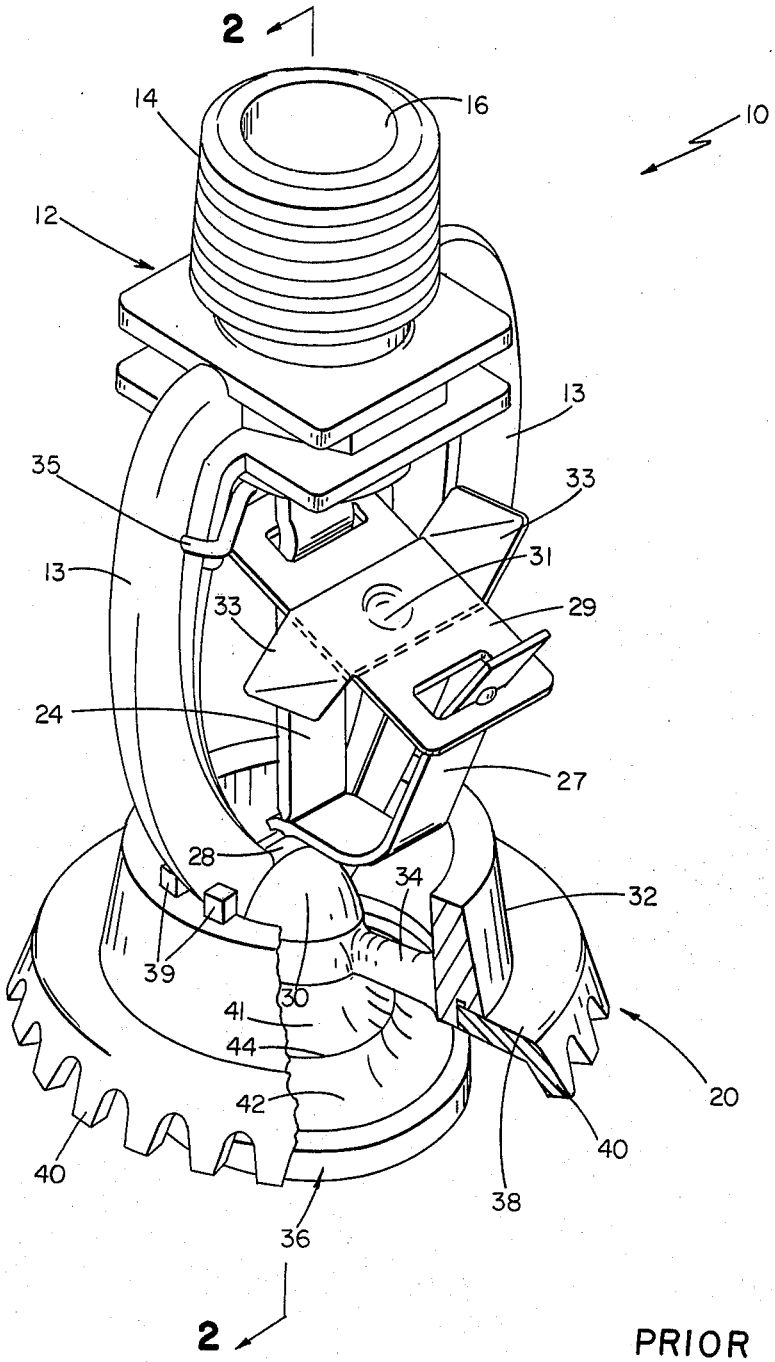
PRIOR ART
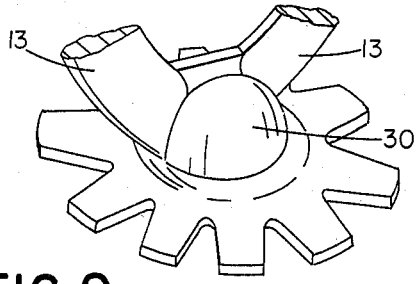
FIG 9

FIG 2
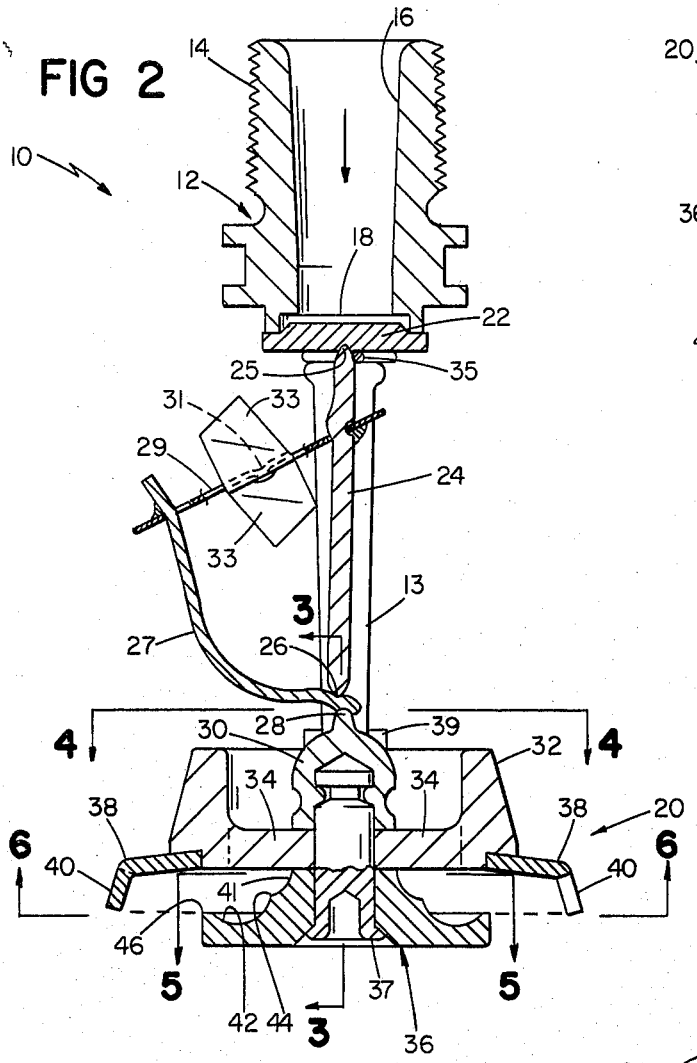
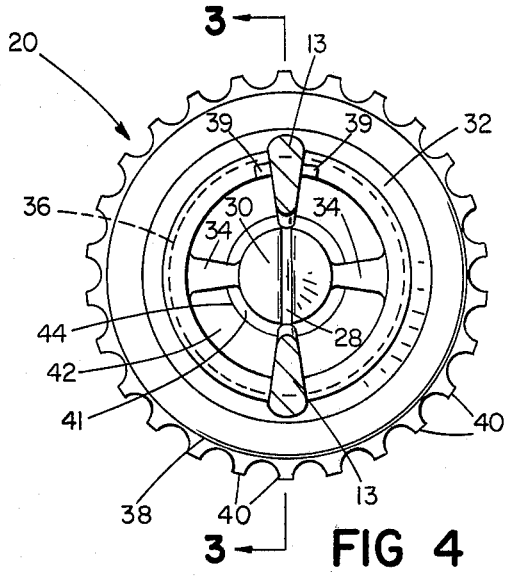
FIG 4
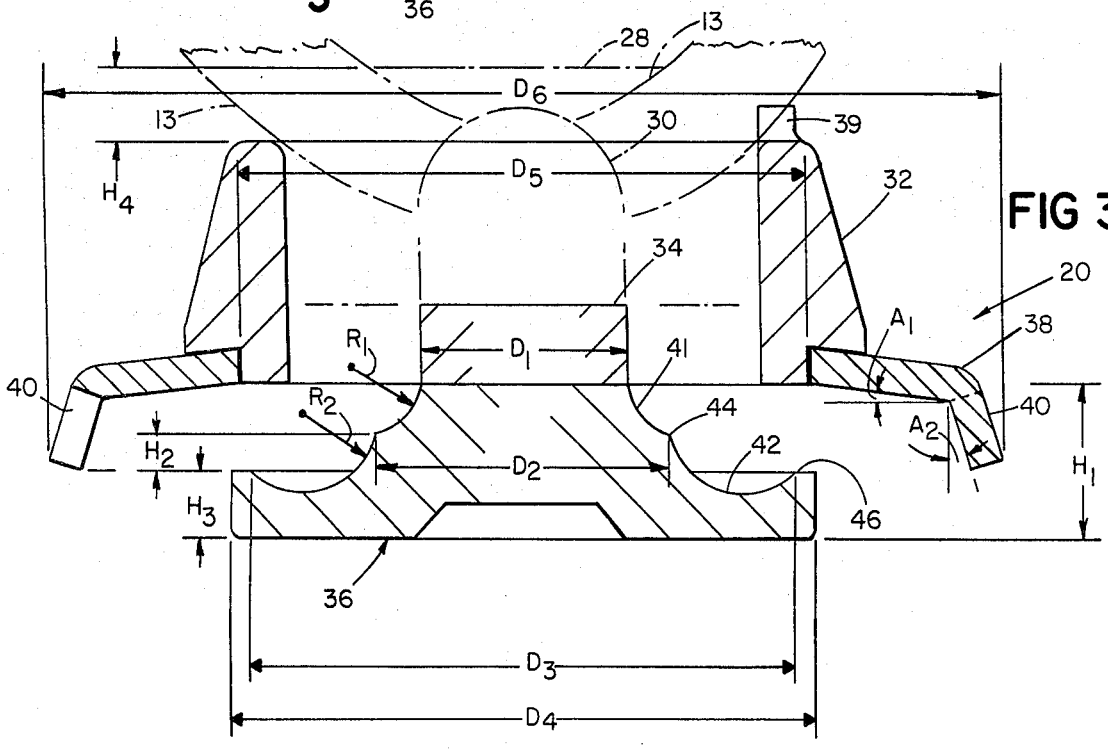
FIG 3

FIG 8
PRIOR ART
| | | | | | |
|---|---|---|---|---|---|
| .085 | .116 | .092 | .123 | .147 | .084 |
| .016 | .050 | .068 | .062 | .051 | .027 |
| .057 | .057 | .106 | .109 | .075 | .097 |
| .038 | .048 | .050 | .056 | .029 | .055 |
| .021 | .063 | .036 | .038 | .070 | .044 |
| .087 | .148 | .107 | .076 | .123 | .082 |
FIG 7
AVERAGE DENSITY IN GPM / FT$^2$
| | | | | | |
|---|---|---|---|---|---|
| .050 | .075 | .060 | .073 | .065 | .066 |
| .066 | .058 | .064 | .062 | .065 | .065 |
| .089 | .133 | .059 | .054 | .114 | .079 |
| .073 | .110 | .060 | .049 | .123 | .071 |
| .079 | .068 | .061 | .064 | .061 | .087 |
| .090 | .070 | .082 | .068 | .055 | .083 |
2FT
2FT
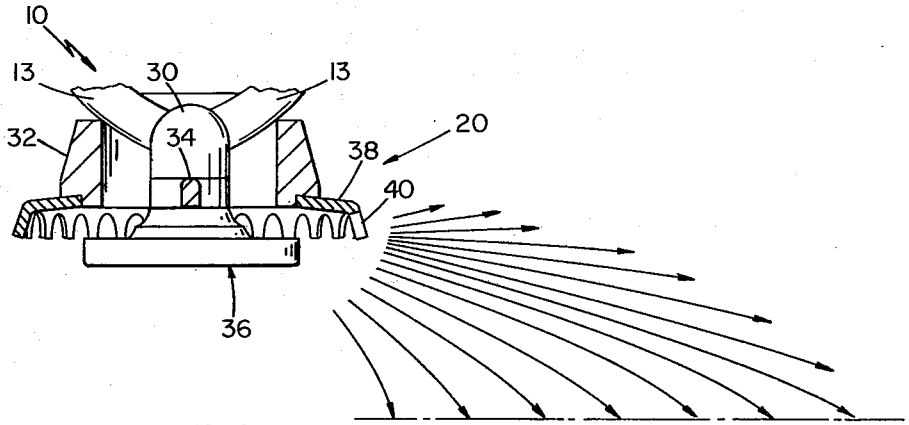
FIG 11
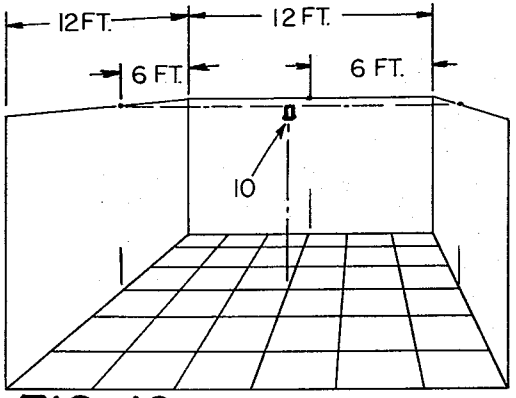
FIG 10

DEFLECTOR WITH SURFACE FOR CIRCUMFERENTIALLY REDISTRIBUTING FLUID FOR IMPROVED SPRAY UNIFORMITY

FIELD OF THE INVENTION

This invention relates to pendent sprinkler heads used in automatic fire-protection sprinkler systems.

BACKGROUND OF THE INVENTION

There exists a need for a pendent type sprinkler head specifically designed to meet the special discharge requirements of residential, automatic, fire-protection sprinkler systems. The special discharge requirements for residential sprinklers are the result of: limited water pressures available for the system; the need to provide coverage, in the case of smaller rooms, with only one sprinkler; and the desire to generate a high percentage of relatively large water drops in the spray.

The water supply to industrial and commercial sprinkler systems is generally fed through relatively large diameter pipes (i.e., 4 inches or greater), and so there are minimal friction losses between the city main and the sprinkler system. In other cases where the available pressure is limited, high-flow producing fire pumps are often used. In residential applications, however, the domestic water supply from the street main is generally fed thru relatively small diameter pipes (i.e. 1½ inches or less) and the emphasis on low cost typically prohibits the use of high-flow pumps. The National Fire Protection Association has indicated that residential sprinkler systems must be designed to help protect against injury, loss of life, and property damage, with as little as 26 gallons per minute (gpm) flow. This criteria limits the number of sprinklers that can effectively discharge in the event of a fire. For the case of a large room (e.g., 14 ft. by 28 ft. and containing four sprinklers), preferably only two of the sprinklers should discharge (i.e. at 13 gpm per sprinkler). Because of this and because only one sprinkler will be called upon to protect a smaller room (e.g. 12 ft. by 12 ft.), a residential sprinkler must provide a much more uniform spray pattern over its entire design area, than is the case for state-of-the-art pendent sprinklers previously developed for industrial/-commercial applications.

In order to improve the chance for occupants to escape or be evacuated, a residential sprinkler must prevent or delay flashover (i.e., uncontrolled spread of the fire). This necessitates controlling a fire in its early stages. Furnishings employing petroleum based materials (e.g., synthetic fibers) are a particular problem in this regard since they can result in fast-developing, high-heat output fires. Relatively large water drops are required to penetrate the updrafts and reach the base of this type of fire. Conventional industrial/commercial pendent sprinklers operating with flow-pressure characteristics equivalent to that required in residential applications, produce a higher percentage of small-atomized water drops than that desired in the residential case.

Prior patent applications of Grinnell Fire Protection Systems Company, Inc. have also concerned a residential sprinkler head. Fischer et al. Ser. No. 34,686 concerns an improved fusible link for reducing response time; Fischer et al. Ser. No. 53,262 now U.S. Pat. No. 4,279,309 discloses a non-circular throat for improving spray uniformity. The subject of both applications are employed in embodiments of the present invention and are herein incorporated by reference.

SUMMARY OF THE INVENTION

The invention features an improved fluid deflection technique for a pendant-type sprinker head. A first deflecting surface facing generally upward is positioned in the path of fluid emerging from the body of the sprinkler and includes a portion shaped to circumferentially redistribute the fluid to improve uniformity of distribution and deflect at least some of the fluid generally outward. A second deflecting surface is positioned radially outward and away from the first deflecting surface, to receive and control the distribution of a portion of the fluid moving outwardly from the first surface; the second deflecting surface having an interior opening and being so positioned that the path of emerging fluid from the sprinkler head body to the first deflecting surface extends through this opening; and the flow paths between said first deflecting surface and the second deflecting surface being circumferentially unobstructed so that the circumferential distribution of the fluid leaving the first surface is not divided as it moves between the first and second surface.

The dependent structure that supports the first deflecting surface is such that it causes a disturbance in the flow before the flow reaches the first deflecting surface and the first deflecting surface is effective in redistributing the fluid to reduce the uneveness in circumferential distribution as a result of the disturbance. Preferably, the first deflecting surface is sized and positioned to oppose the majority of the fluid emerging from the body of the sprinkler.

In preferred embodiments, the first fluid deflecting surface includes an outer circular portion having a vertical cross-section of upwardly concave form and a radially outer lip raised above the lowermost portion thereof to form a circumferential channel. The fluid stream emitted from the body of the sprinkler is divided prior to reaching the first deflecting surface by an apex element to which the first deflecting element is attached and which is preferably supported by two main supporting arms, that extend from the body. Two additional arms radially extending from the apex and preferably perpendicular to the main support arms support the second deflecting element. The fluid stream is thereby divided into four separate streams prior to reaching the first deflector surface and from the point of time of reaching the first deflecting surface, the flow is not divided by supporting structure. The first deflecting surface is therefore effective to reduce the uneveness in circumferential distribution caused by all supports of the deflecting structure. A circular guide channels the separated streams towards the first deflecting surface. A second concave circular channel is formed in the first surface above and radially inward from the first-mentioned concave channel, to vary the outward distribution of the spray to the second deflecting surface. The second deflecting surface has tines at its outer periphery for further separating the spray into a portion that is directed towards the floor and a portion that is directed towards the walls of the room.

In a preferred embodiment the outer lip of the first deflecting surface is generally aligned with the lower edge of tines that define the lower part of the second deflecting surface while the cusp or ridge at the juncture of the first and second concave portions of the first deflecting surface lies below a ring portion of the second deflecting surface.

In addition to providing a more uniform spray density over the floor and wall areas to be covered by the sprinkler, the invention provides a high percentage of large water drops in a pendent sprinkler, comparable to that which can be achieved with an upright sprinkler. The larger water drops are better able to penetrate the updrafts of fast-developing, high heat output fires.

PREFERRED EMBODIMENT

A preferred embodiment of the invention will now be described, after first briefly describing the drawings.

Drawings

FIG. 1 is a perspective view, partially broken away, of said embodiment.

FIG. 2 is a sectional view taken at 2—2 of FIG. 1.

FIG. 3 is an enlarged sectional view at 3—3 of FIGS. 2 and 4 showing the deflector assembly of said embodiment.

FIG. 4 is a view at 4—4 of FIG. 2 looking down at the deflector assembly.

FIG. 7 shows spray densities achieved in a test of said embodiment.

FIG. 8 shows spray densities achieved in a test of the same pendent sprinkler but with the prior art deflector of FIG. 9 substituted for the deflector of the invention.

FIG. 9 is a plan view of a conventional prior art deflector for a pendent sprinkler.

FIG. 10 is a diagrammatic perspective view of the 12 ft. by 12 ft. room used for the tests of FIGS. 7 and 8

FIG. 11 is a cross sectional view of the deflector including diagrammatic spray-representing arrows to show the radial spray distribution of said embodiment.

STRUCTURE

Figure 6:
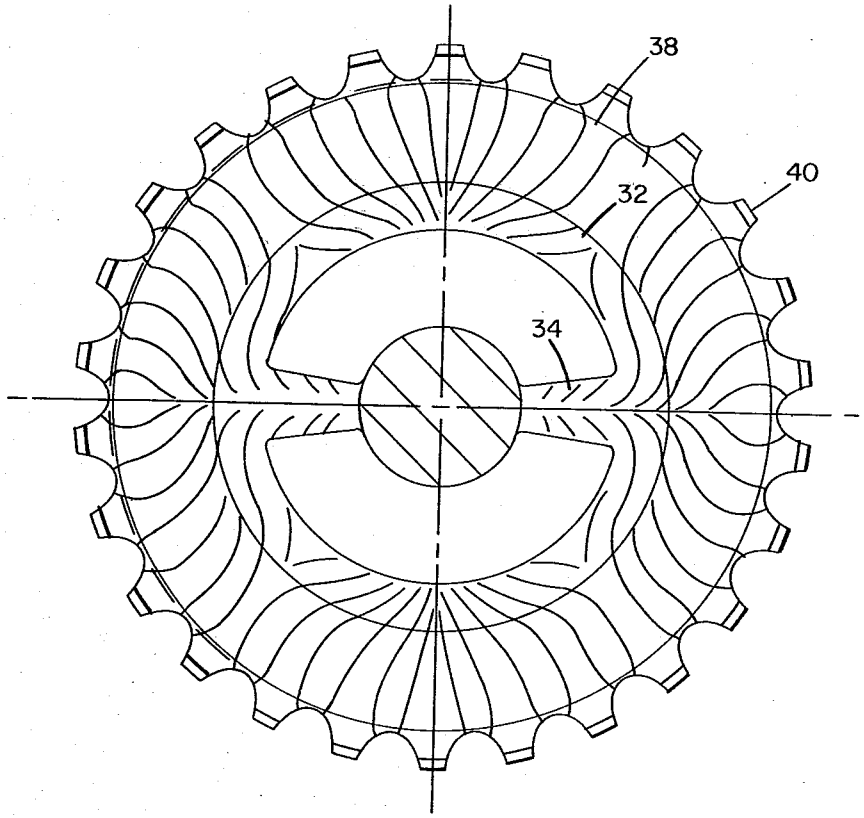
FIG. 6 is a view at 6—6 of FIG. 2 looking up at the second deflector of said embodiment and including diagrammatic streamlines showing the flow pattern on said second deflector.

There is shown in FIGS. 1 and 2 an automatic, pendent, fire-protection sprinkler head 10, which has a body 12 with two support arms 13 extending from the body to an apex 30, to which a deflector assembly 20 is attached. Pipe threads 14 on body 12 provide a means for connecting the sprinkler head to a supply of fire-retardant fluid (e.g., the domestic water supply of a home or other residential structure). Through body 12 there extends a passage 16 leading from the fluid supply system to a discharge orifice 18, which is normally closed by a closure element 22 held in place by strut 24.

Strut 24 extends between an abutment groove 25 on the underside of closure 22 and another groove 26 in a resilient lever 27. Groove 26 is slightly offset from the vertical centerline of passage 16. The lever 27 pivots on a swaged ridge 28 located on apex 30 at the centerline of the passage. Lever 27 is held in place by fusible link 29 extending between the top end of the lever and a groove in strut 24.

An ejection spring 35 extending from arms 13 to strut 24 provides a transverse force on the top of strut 24 to assist in clearing away the various elements closing orifice 18 after fusible link 29 has separated in response to a fire.

Fusible link 29 consists of two halves made of copper sheet metal laminated with solder in a lap joint to form a fusible region. Dimple 31 in the fusible region provides added strength. Each half of the link has an air-diverting fin element 33. The link is constructed to respond to the special requirements of residential sprinklers, e.g. four times or more faster than usual industrial or commercial sprinklers (e.g. respond within 6 to 10 seconds under residential test conditions as defined by Underwriters Laboratories, Inc.). For further details for the presently preferred embodiment reference is made to my copending application. Ser. No. 34,686, incorporated by reference herein.

Attached to the base of apex 30 is a deflector assembly. Ring-shaped support 32 (cast) surrounds the apex and is supported therefrom by two integral arms 34. A first circular deflector element 36 (cast or machined) is mounted beneath guide 32 by pin 37 connected to apex 30. A second annular deflector 38 (stamped) is brazed to support 32. A plurality of spaced-apart tines 40 extend generally downward from the periphery of second deflector 38. The upper surface of support 32 is located a short distance below main arms 13 and it has an inner generally cylindrical flow guiding surface. Integral tabs 39 on support 32 straddle one arm 13 to align support arms 34 at essentially 90° with respect to main arms 13.

The first deflector element includes two concave annular surfaces 41, 42, which intersect to define a raised annular cusp or ridge 44. Raised lip 46 surrounds the outer rim of the first deflector surface.

In detail for one of the embodiments of the invention described herein, the upper annular surface 41 is located inwardly of the lower surface, and, in vertical cross section, extends down and outwardly from vertical tangency to the cusp which is located slightly inward from horizontal tangency. The lower annular concave surface begins at the cusp and extends downwardly and outwardly to horizontal tangency, thence upwardly and outwardly to the raised lip.

Referring to FIG. 3, the nominal dimensions of the first and second deflector elements for one embodiment, are as given in the following table (in inches):

| | |
|---|---|
| R1 | 0.10 |
| R2 | 0.12 |
| D1 | 0.34 |
| D2 | 0.48 |
| D3 | 0.9 |
| D4 | 0.96 |
| D5 | 0.95 |
| D6 | 1.58 |
| H1 | 0.15 |
| H2 | 0.06 |
| H3 | 0.11 |
| H4 | 0.19 |

There are twenty-six tines 40 spaced around the periphery of second deflector 38. The tines are angled outward 17° (angle A2 in FIG. 3) from the vertical, to an outside diameter of 1.58 inches at their tips. The lower surface of the second deflector is inclined downward slightly at 6° (angle A1 in FIG. 3) from the horizontal. Second deflector 38 including the tines is stamped from 0.05 inch thick sheet metal.

Both the main support arms 13 (supporting the apex and first deflector from the threaded body) and the arms 34 (supporting the second deflector from the apex) are positioned in the path of the fluid in advance of the fluid reaching the first deflecting surface. The position of the periphery of the second deflecting surface is arranged to receive fluid that has an outward component.

OPERATION

In the absence of fire, fusible link 29 provides a restraining force on lever 27 which through mechanical advantage is amplified to produce a much larger upward force on strut 24 to seal orifice 18.

When link 29 is heated sufficiently to cause the solder laminating its two halves to approach melting temperature (about 140° F.) and thereby lose its strength, the two halves separate, and lever 27 rotates downward, thereby removing the upward force on strut 24 and closure 22. The strut, closure, and lever are blown away by water exiting from orifice 18, with spring 35 helping to clear away the various elements. Water strikes arms 13 and apex 30 and is divided into two segregated streams within flow guide 32. These two streams are then each in turn divided in two upon passing guide support arms 34, producing four segregated streams, which impinge on concave outer surface 42 of the first deflector element 36. The impact locations of the four streams are designated with the letter S in FIG. 5.

Figure 5:
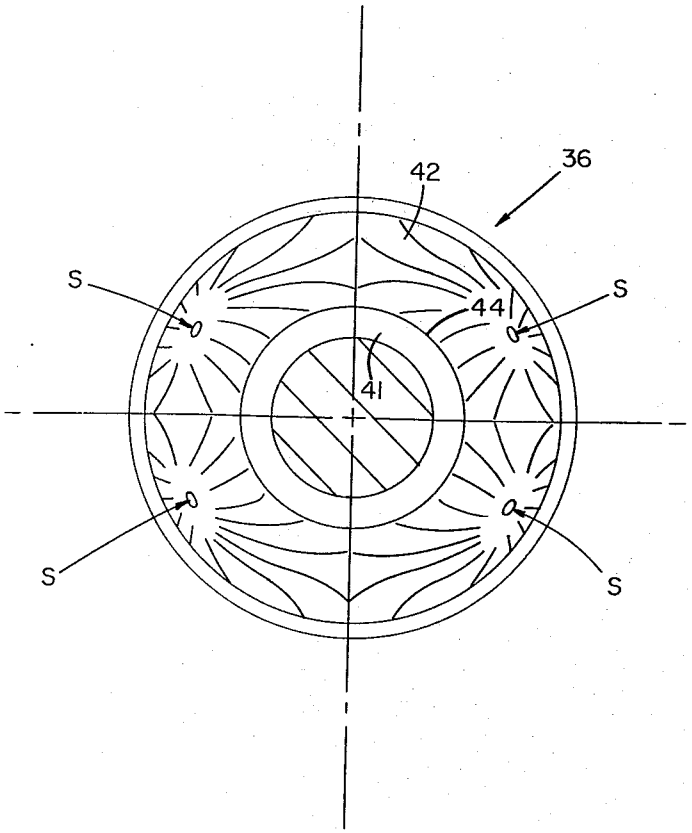
FIG. 5 is a view at 5—5 of FIG. 2 looking down at the first deflector element of said embodiment and including diagrammatic streamlines showing the flow pattern on said first deflector.

An important aspect of the improved spray distribution of the invention is that the shape and position of surface 42 causes portions of the water in each of the streams to spread circumferentially to regions of less density, as suggested by the diagrammatic streamlines in FIG. 5. This circumferential movement regions the four segregated streams and produces a more circumferentially uniform distribution, i.e., roughly equal amounts of water depart from the compensating element at each circumferential location.

Concave annular surface 41, which is above and inside surface 42 and has a downward and outward slope, functions to direct fluid to the regions of larger radius from the head. The selected location of cusp 44 in relation to lip 46 and tines 40 of deflector 36 determines the amount of fluid affected by the upper concave surface 41.

Some of the water leaving first deflector 36 is directed away from the sprinkler head without striking second deflector 38; the remainder strikes the deflector. The flow pattern on second deflector 38 is suggested by the diagrammatic streamlines in FIG. 6. There is circumferentially nearly uniform outward flow at the radially outer edge of the deflector, where tines 40 are located, as suggested by the relatively equal spacing and general radial direction of the streamlines (FIG. 6) at the outer edge. The streamlines in FIGS. 5 and 6 are determined from impressions left by the flow upon paint applied to the first and second deflectors.

As suggested by the arrangement of spray-representing arrows in FIG. 11, and the flow distribution pattern of FIG. 7, discussed below, greater percentages of water are directed toward outer circumferences on the floor than to inner circumferences (relative to the vertical center line) to compensate for the larger area of the regions to be covered at the outer circumferences. A portion of the uppermost flow passing between the tines is fragmented into an upwardly and outwardly proceeding cooling mist, which assists in cooling the region just below the ceiling.

FIG. 7 depicts the floor water density distribution achieved in a test of the preferred embodiment when operated at 15 gpm. The sprinkler head 10 was located at the center of a 12 ft. square room as shown diagrammatically in FIG. 10; its orientation is designated by the locations of apex support arms 13. The densities given are in units of gpm/ft$^2$. More uniform spray density is achieved; the minimum average density is 0.050 gpm/ft$^2$ over each 2 ft. by 2 ft. sampling area and the maximum is 0.133 gpm/ft$^2$.

To compare these results to the prior art, an identical test was run with a conventional pendent deflector of the type shown in FIG. 9 installed on the apex of the sprinkler head. These results, which represent a typical example of the spray density variation of a conventional pendent sprinkler, are presented in FIG. 8. It can be seen that much less uniformity was achieved. The minimum density was 0.016 gpm/ft$^2$, and the maximum 0.148 gpm/ft$^2$. With this spray pattern, more flow to the sprinkler would be required in order to provide a preferred minimum average density of 0.040 gpm/ft.$^2$ on all 2 ft. by 2 ft. floor areas. Visual observation of the sprinkler head with the conventional deflector showed a predominantly finer, mist-like spray rather than the predominantly large drops achieved with the preferred embodiment. Furthermore, the conventional pendent sprinkler had a very well defined upper spray boundary which was directed slightly downward forming a pronounced cone of spray below the sprinkler.

By contrast, the preferred embodiment deflected some water upward above horizontal with a combination of large drops and fine spray, thereby providing spray coverage higher on the room walls and filling the region below the ceiling with spray to help cool hot gases there. Cooling the region just below the ceiling helps prevent hot gases from using that region as a conduit for traveling above the sprinkler spray to adjacent areas of the room of other rooms and activating additional sprinkler heads, which reduces the water supply available to the sprinkler heads at the fire site.

A comparison of FIGS. 7 and 8 also shows another advantage of the embodied invention. Note the variation in FIG. 8 average densities for equivalent 2 ft. by 2 ft. areas on opposite sides of main arms 13. This variation is principally caused by the center of the deflector (FIG. 9) being not precisely aligned with the longitudinal axis thru the center of discharge orifice 18 due to typical machining variations). The water distribution characteristics of the embodied invention is significantly less sensitive to this manufacturing variation due to the circumferential fluid redistribution effects of the invention (see FIG. 7).

It can thus be seen that the stringent requirements of a residential sprinkler can be met with parts that do not move during emission of the fire protection spray and are practical and relatively inexpensive to manufacture.

OTHER EMBODIMENTS

Other embodiments of the invention are within the scope of the following claims. For example, other arrangements could be used for supporting the deflector assembly, including moving the main support arms 13 from apex 30 to support 32 and adding additional arms 34, as necessary, between support 32 and the apex. The dividing effect of such arms would remain upstream of the first deflecting surface, so that its circumferential redistribution pattern would not subsequently be divided. Other means could be employed for opening orifice 18 in response to a fire; some arrangements would not require the apex 30 support a strut and would thus allow the apex to have a more perfectly conical shape for improved flow distribution. A single concave surface could replace surfaces 40, 42, although generally at a penalty in spray nonuniformity. The deflector could be constructed to provide oblong or other spray patterns, e.g. for use in similarly shaped areas. The sprinklers may be of the reclosing or deluge types, or may be incorporated in a concealed sprinker which drops down upon actuation and then remains stationary during operation.

What is claimed is:

1. In a fire-protection sprinkler head of the pendent type, said head including a body with means for connecting said head to a supply of fire-retardant fluid, a passage through said body for said fluid, a closure for said passage, means for opening said closure in response to a fire, and a spray-forming deflector means supported below said passage by a dependent structure that extends from said body, said deflector means positioned in the path of fluid emerging from said passage, the improvement wherein said deflector means includes:

a first deflecting surface directly in the path of said emerging fluid and facing generally upward, said first deflecting surface including a portion shaped to circumferentially redistribute fluid to improve uniformity of distribution and deflect at least some of said fluid generally outward; and a second deflecting surface positioned outward and away from said first deflecting surface to receive and control the distribution of a portion of the fluid moving outwardly from said first deflecting surface, said second deflecting surface having an interior opening and being so positioned that the path of the fluid from said passage to said first deflecting surface passes through said opening, and the flow paths between said first deflecting surface and said second deflecting surface being circumferentially unobstructed so that the circumferential distribution of said fluid leaving said first deflecting surface is not divided as it moves between said first deflecting surface and said second deflecting surface, wherein said first deflecting surface has an outer circular portion having a vertical cross-section of upwardly concave form defining a first concave surface, and wherein said first deflecting surface includes a second concave circular surface radially inside of and above said first concave circular surface, said first and second concave surfaces are joined at a circular ridge, and the location of said ridge and the shape of said second concave surface are selected to influence the radial distribution of fluid in the spray pattern generated by said sprinkler head.

2. The sprinkler head of claim 1 wherein said second deflecting surface includes a generally horizontal ring of larger diameter than said first deflecting surface and a plurality of downwardly directed tines located around the periphery of said ring and wherein said first and second deflecting surfaces are shaped and separated vertically sufficiently to that said circular ridge joining said first and second concave surfaces of said first deflecting surface is positioned below said ring portion of said second deflecting surface, and said tines are spaced generally radially outward from said first deflecting surface.

3. In a fire-protection sprinkler head of the pendent type, said head including a body with means for connecting said head to a supply of fire-retardant fluid, a passage through said body for said fluid, a closure for said passage, means for opening said closure in response to a fire, and a spray-forming deflector means supported below said passage by a dependent structure that extends from said body, said deflector means positioned in the path of fluid emerging from said passage, the improvement wherein said deflector means includes:

a first deflecting surface directly in the path of said emerging fluid and facing generally upward, said first deflecting surface including a portion shaped to circumferentially redistribute fluid to improve uniformity of distribution and deflect at least some of said fluid generally outward; and a second deflecting surface positioned outward and away from said first deflecting surface to receive and control the distribution of a portion of the fluid moving outwardly from said first deflecting surface, said second deflecting surface having an interior opening and being so positioned that the path of the fluid from said passage to said first deflecting surface passes through said opening, and the flow paths between said first deflecting surface and said second deflecting surface being circumferentially unobstructed so that the circumferential distribution of said fluid leaving said first deflecting surface is not divided as it moves between said first deflecting surface and said second deflecting surface, wherein said first deflecting surface has an outer circular portion having a vertical cross-section of upwardly concave form defining a first concave surface, and wherein said first deflecting surface includes a second concave circular surface radially inside of and above said first concave circular surface and a radially-outer lip raised above the lowermost portion of said first deflecting surface, said first and second concave surfaces are joined by a circular ridge, a cylindrical surface forms the connection between an apex element and said second concave surface, said second concave surface, in vertical cross section, begins at nearly vertical tangency with said cylindrical surface and extends downwardly and radially outwardly to said ridge, said first concave surface, in vertical cross section, begins at said ridge and extends downwardly and outwardly through a point of horizontal slope and then upwardly and outwardly to said radially-outer lip.

4. The sprinkler head of claims 1 or 3 wherein said dependent structure supporting said first deflecting surface causes a disturbance in the flow before said fluid reaches said first deflecting surface, and said first deflecting surface is effective in redistributing fluid to reduce the unevenness in circumferential distribution of fluid as a result of said disturbance.

* * * * *

UNITED STATES PATENT OFFICE

CERTIFICATE OF CORRECTION

Patent No. 4,405,018 Dated September 20, 1983

Inventor(s) Michael A. Fischer

It is certified that error appears in the above-identified patent and that said Letters Patent are hereby corrected as shown below:

In the Abstract, line 5, "spaced" is changed to --shaped--.

Column 5, line 29, "regions" is changed to --rejoins--.

Column 7, line 5, "sprinker" is changed to --sprinkler--.

Column 7, line 61, "to that" is changed to --so that--.

Signed and Sealed this

*Twenty-first* Day of *August 1984*

[SEAL]

*Attest:*

GERALD J. MOSSINGHOFF

*Attesting Officer*

*Commissioner of Patents and Trademarks*